United States Patent [19]

Voith et al.

[11] Patent Number: 4,984,629

[45] Date of Patent: Jan. 15, 1991

[54] BALL COLLECTOR AND FILLING APPARATUS FOR CIRCULATING BALL CLEANING SYSTEM

[75] Inventors: Donald J. Voith, Milwaukee; David G. Paegelow, West Bend; John E. Jagodzinski, Milwaukee, all of Wis.

[73] Assignee: Water Services of America, Inc., Milwaukee, Wis.

[21] Appl. No.: 406,800

[22] Filed: Sep. 13, 1989

[51] Int. Cl.[5] ..... F28G 1/12; B08B 9/04

[52] U.S. Cl. ..... 165/95; 15/3.5; 15/3.51

[58] Field of Search ..... 165/95; 15/3.5, 3.51

[56] References Cited

U.S. PATENT DOCUMENTS

| | | | |
|---|---|---|---|
| 3,872,920 | 3/1975 | Honma et al. | 165/95 |
| 3,919,732 | 11/1975 | Honma et al. | 165/95 |
| 4,314,604 | 2/1982 | Koller | 165/95 |
| 4,447,925 | 5/1984 | Riedel | 165/95 |
| 4,544,027 | 10/1985 | Goldberg et al. | 165/95 |
| 4,578,838 | 4/1986 | Prinz | 165/95 |
| 4,620,589 | 11/1986 | Koller | 165/95 |
| 4,865,121 | 9/1989 | Ben-Dosa | 165/95 |

FOREIGN PATENT DOCUMENTS

| | | | |
|---|---|---|---|
| 14190 | 1/1982 | Japan | 165/95 |
| 318498 | 12/1988 | Japan | 165/95 |

*Primary Examiner*—John Rivell
*Assistant Examiner*—L. R. Leo
*Attorney, Agent, or Firm*—Andrus, Sceales, Starke & Sawall

[57] ABSTRACT

A ball collecting apparatus for a pipe cleaning system utilizing circulating foam rubber balls includes a cylindrical housing having a rotary ball retaining screen disposed therein which is movable between a ball circulating position, a ball collecting and holding position, and a ball discharging position in a simple and efficient manner. In its recirculating position, a screen is disposed to permit the balls to flow directly from the housing inlet to the housing outlet for recirculation without interruption. When rotated to the collecting and holding position, the screen retains the balls thereon, prevents their passage through the housing outlet and preferably also prevents inadvertent entry of the balls into a ball discharge outlet. The discharge outlet is located near the bottom of the housing and rotation of the screen to the ball discharging position, along with appropriate closure of the flow inlet and outlet oepnings, allows the collected balls to be discharged by gravity and removed the system. The collecting apparatus also provides in situ de-aeration of newly added dry balls. Replacement balls are added through an upper inlet opening, the housing is filled with water to a desired level, all valves are closed and the inlet opening sealed, and a vacuum is drawn within the housing above the water level to de-aerate the balls floating therein, thereby causing them to become saturated with water and allowing them to be admitted directly into the system.

21 Claims, 2 Drawing Sheets

BALL COLLECTOR AND FILLING APPARATUS FOR CIRCULATING BALL CLEANING SYSTEM

BACKGROUND OF THE INVENTION

The present invention pertains to a system utilizing recirculating porous foam rubber balls as a tube cleaning media and, more particularly, to an apparatus for collecting and removing balls from the system and for adding new balls to the system.

It is well known in the art to provide the condenser in a heat exchanger with a large number of parallel tubes through which cooling water is directed. The condenser tubes are supplied with cooling water by a pump-operated recirculating system, typically receiving water from a cooling tower, circulating it through the heat exchanger condenser and returning it to the cooling tower.

Various methods are utilized for periodically cleaning the condenser tubes to remove deposits which accumulate therein. Typically, the condenser tubes may be about 1" in diameter and, in one known method, resilient foam rubber balls having a diameter slightly larger than the tubes are circulated therethrough with the cooling water. The balls are compressed slightly as they enter the tubes and are forced through the tubes by water pressure carrying accumulated deposits with them. The balls are injected into the cooling water flow from a parallel branch upstream from the condenser and are removed from the stream after they exit the condenser and diverted from the main cooling water flow back into the parallel branch for recirculation or collection. To separate the balls from the return flow to the cooling tower, a ball strainer comprising a large screen is disposed in the return flow piping system where the balls are screened from the flow and diverted into the collection/recirculation branch.

Balls which are diverted from the main cooling water stream by the ball strainer and shunted into the parallel recirculation branch are delivered to a ball collector apparatus which, in typical prior art systems, may be operated to allow the balls to flow directly therethrough for recirculation, to collect and hold the balls while allowing only the water to continue through the collector, or to discharge the balls from the system. The porous foam rubber balls used in these systems may have diameters in the range typically less than 1 ½" (just slightly larger than the condenser tubes through which they are forced to pass). Abrasive wear on the balls eventually reduces their diameter and requires them to be replaced. Thus, a ball collector apparatus also typically provides a means for adding new balls to the system to replace those discharged after collection.

One common prior art ball collector apparatus includes a collector housing having a removable perforated basket inside. The water flow in the recirculation branch from the ball strainer, including the saturated balls, is passed into the perforated basket which has a bottom door that is left open to allow the balls to recirculate through the heat exchanger and which is closed when it is desired to collect the balls. Once the balls are collected, flow through the collector housing is terminated and the basket is lifted out of the housing. This prior art apparatus requires complex mechanisms for opening and closing the door in the lower portion of the basket and still permitting removal of the basket from the collector housing. In a prior art variation of the foregoing apparatus, the collecting basket does not have to be lifted from the housing to remove the balls, but rather direct axis to the basket through the housing side wall is provided which, when open, allows the balls to tumble by gravity out of the basket and housing. However, this apparatus still requires a basket opening mechanism for recirculating flow, and an additional mechanism to operate the side discharge door.

U.S. Pat. No. 4,620,589 discloses an apparatus for diverting the cleaning balls from the main cooling water flow and an apparatus for collecting the balls and removing them from the parallel recirculation branch. The collecting and removing device operates in essentially the same manner as the removable basket previously described, except that the entire portion of the collector housing including the basket form a separable lock which can be isolated and completely removed from the system, the worn balls are removed from the lock and the lock is refilled with new balls and reinserted in the system.

It is necessary or highly desirable to somehow de-aerate new dry balls which are added to a ball cleaning system. Although the balls are porous and absorbent, they are not easily saturated by the cooling water without initial de-aeration, e.g. by squeezing or the like.

U.S. Pat. No. 4,314,604 describes an apparatus for sizing balls which have been removed from a system to take out of service those which are undersized and to return for readdition to the system those which are still large enough. The system also includes an apparatus for de-aerating balls returned to or initially put into service by squeezing them between a pair of counter rotating rolls immersed in water. It is also known to de-aerate dry balls outside of a ball collector by evacuating a container of water with dry balls floating thereon. However, the saturated balls must then be transferred into the system via the ball collector housing or at some other convenient point.

It is apparent, therefore, that prior art systems and apparatus for cleaning ball collection, removal and addition are mechanically complex and cumbersome to operate. It is well known that the complexity of these devices also substantially shortens their operating life, leading to costly and time consuming repair and replacement. The addition of new cleaning balls to a system by various means external to the ball collecting and discharge apparatus also leaves much to be desired.

SUMMARY OF THE INVENTION

In accordance with the present invention, a ball collecting apparatus is provided for a pipe cleaning system utilizing porous resilient foam rubber balls which are circulated in a flow of water through the pipes to be cleaned, which ball collecting apparatus includes a relatively simply constructed and operated rotary strainer which is selectively positionable to recirculate the balls through the system, collect and hold the balls, or discharge the balls from the system. The collecting apparatus includes a housing having a cylindrical outer wall and opposite end walls, the end walls supporting an internal screen within the housing for rotation on the axis of the cylindrical outer wall. The housing includes a flow inlet, a flow outlet and a ball outlet and the ball-retaining screen is selectively rotatable between a ball recirculating position with the flow inlet and flow outlet disposed on the ball retaining side of the screen, a ball collecting and holding position with the flow inlet disposed on the ball-retaining side of the screen and a ball discharging position with the ball outlet disposed on the ball retaining side of the screen. Each of the flow inlet, flow outlet and ball outlet are provided with flow control means for controlling the flow through the housing and for effecting discharge through the ball outlet.

The housing is preferably disposed with the axis of the ball-retaining screen horizontally disposed. The flow inlet and flow outlet may be disposed in one end wall and the ball outlet in the lower portion of the cylindrical side wall below the level of the flow inlet and outlet, such that the balls may be discharged by gravity flow from the housing.

The ball collecting apparatus also includes flow control valves for each of the flow inlet, flow outlet, and ball outlet. In its preferred embodiment, the ball-retaining screen has a planar ball-retaining surface and is rotatable on its axis to serially establish the recirculating, collecting and discharging positions through rotation in one direction. Rotation of the screen through the full range of positions and return in the reverse direction to the recirculating position may be accommodated with as little as 90° or one-quarter turn of rotation. The pivot shaft providing the axis of rotation for the screen is conveniently journalled in the end walls and attached to an outside operator for either manual or automatic rotary control.

The collector housing also includes a ball filling inlet in the upper portion thereof, preferably above the flow inlet and flow outlet. Access to the interior of the housing via the filling inlet is provided by a removable cover. By filling the housing with dry balls and attaching a source of vacuum to the housing above a selected water level, the balls may be de-aerated in situ and immediately placed in service.

In accordance with the de-aeration method, the flow of water through the housing is terminated, the ball inlet is opened and dry balls are inserted into the housing, water is added to a desired level below the opening, the opening is sealed, and the interior of the housing evacuated. Prior to deaeration, worn balls may be collected from the system and drained from the housing through the ball outlet.

DETAILED DESCRIPTION OF THE PREFERRED EMBODIMENT

Figure 1:
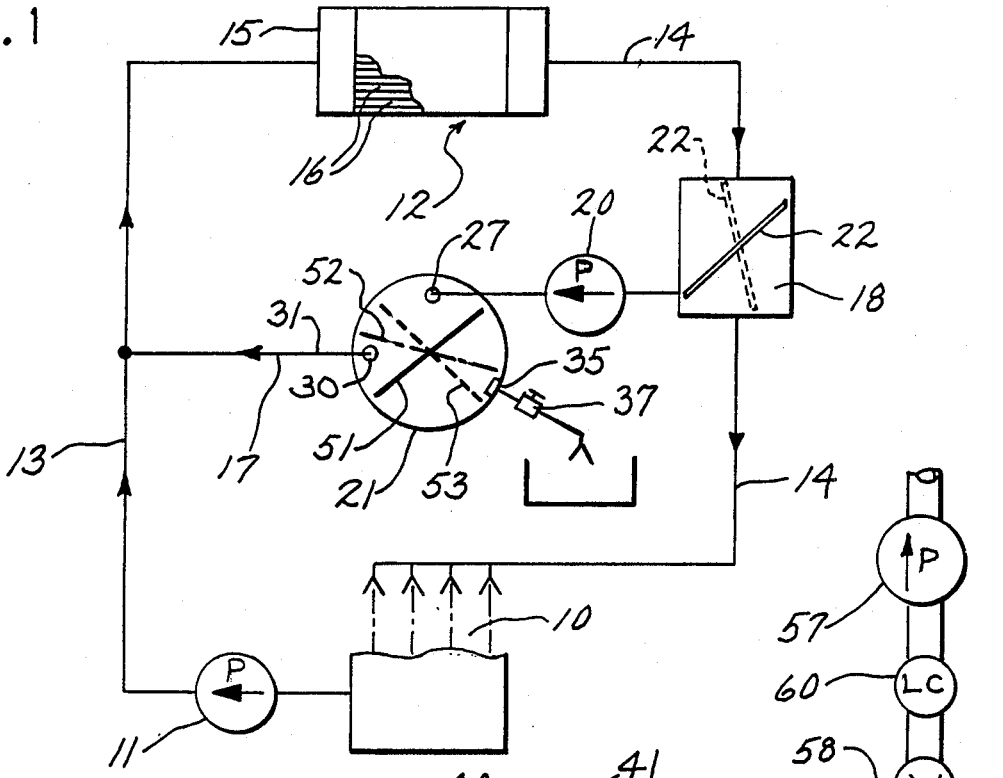
FIG. 1 is a schematic representation of a pipe cleaning system, including the ball collecting apparatus of the present invention.

Referring initially to FIG. 1, a typical cooling water circulation system receives a supply of cooling water from a cooling tower 10 which is circulated by a pump 11 via a main supply pipe 13 through a heat exchanger 12 and back to the cooling tower via a main return pipe 14. The heat exchanger includes a condenser 15 comprising a large number of small tubes 16 through which the cooling water flows.

Periodically, the tubes 16 in the condenser must be cleaned of deposits which accumulate therein. In the system shown, a large number of foam rubber balls of a diameter slightly larger than the tubes 16 are circulated with the cooling water through the condenser where the balls randomly are forced by system pressure through the tubes where they strip deposits from the tube walls. The balls are confined to flow through the condenser by a parallel branch pipe 17 disposed between the main supply line 13 and the return line 14. Balls exiting the condenser 15 are taken out of the main cooling water flow by a ball strainer 18 which diverts the balls into the branch pipe 17 under the influence of a ball circulating pump 20. Branch pipe 17 is just large enough to easily accommodate the movement of the balls therethrough and, therefore, does not divert a significant volume of cooling water from the main return line 14. For example, the main cooling water lines may be several feet or larger in diameter. The condenser tubes 16 may be typically less than 1 ½" in diameter and the cleaning balls in slightly larger in diameter. The ball recirculating branch pipe 17 may, correspondingly, range in size of 2 ½" to 3". The foregoing sizes are merely exemplary and al of them may vary substantially.

The cleaning balls are not continuously circulated through the heat exchanger and, therefore, provision must be made to periodically collect the balls which are initially removed from the main line by the ball strainer 18. A ball collector 21 is disposed in the branch pipe line 17 and, in a fully open position, simply allows the cleaning balls to pass straight through for recirculation. The ball collector 21 also typically includes a collecting position in which an internal collecting screen is oriented to strain the balls from the circulating water flow through the branch pipe 17. The balls are typically collected and held such that the screen 22 in the ball strainer 18 may be rotated from its full line ball straining position in FIG. 1 to the dotted line backwash position such that the cooling water flow through the strainer will clean the screen of accumulated debris and the like. The ball collector 21 also typically includes a ball removal position, such that cleaning balls which have become worn to the point that they are undersized or otherwise ineffective can be removed from the system and replaced.

Figure 2:
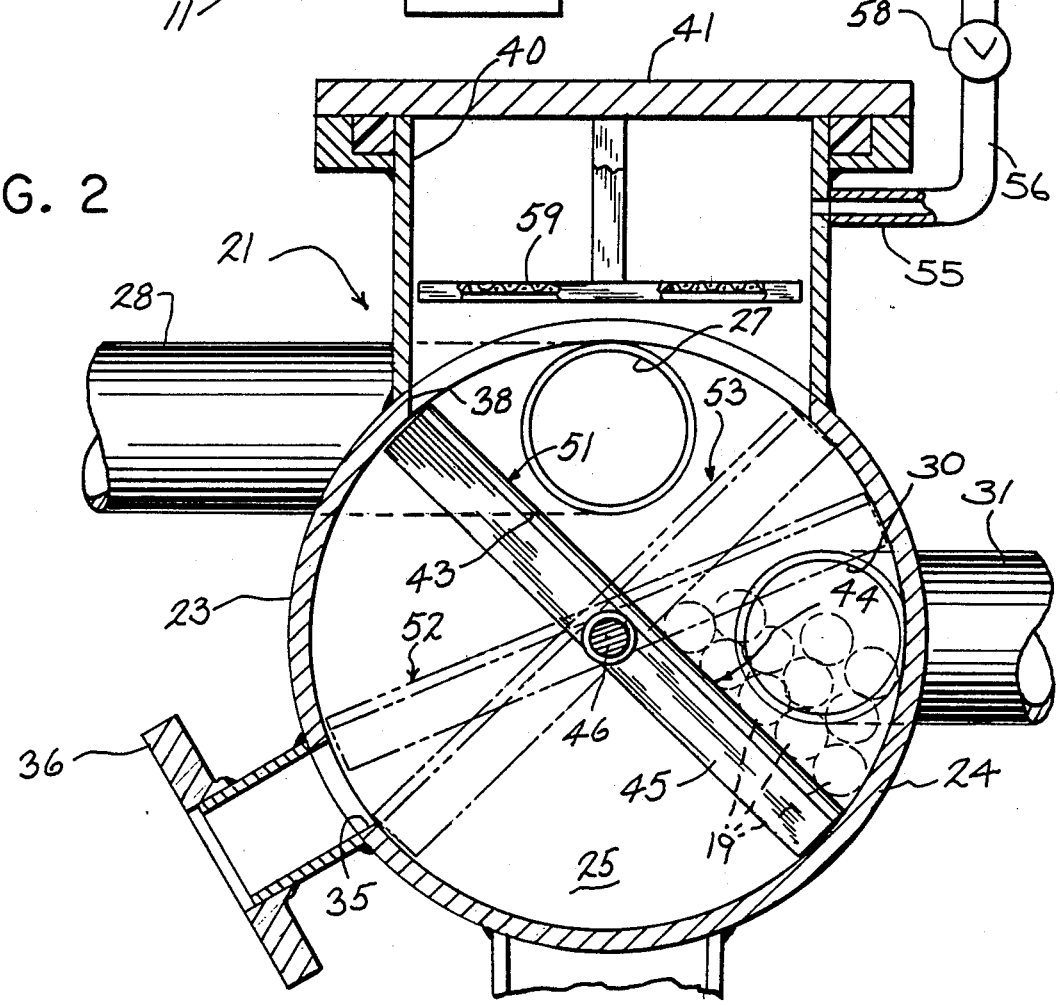
FIG. 2 is an enlarged sectional end elevation of the collecting apparatus of the present invention.
Figure 3:
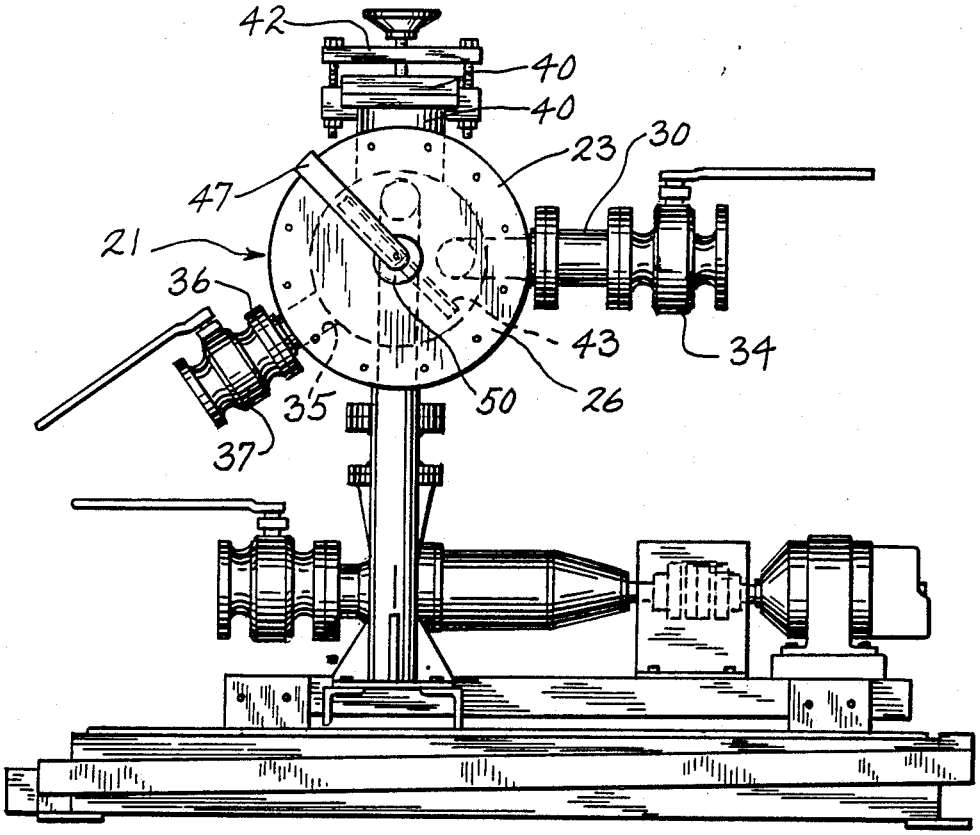
FIG. 3 is an end elevation of the ball collecting apparatus shown in FIG. 2.
Figure 4:
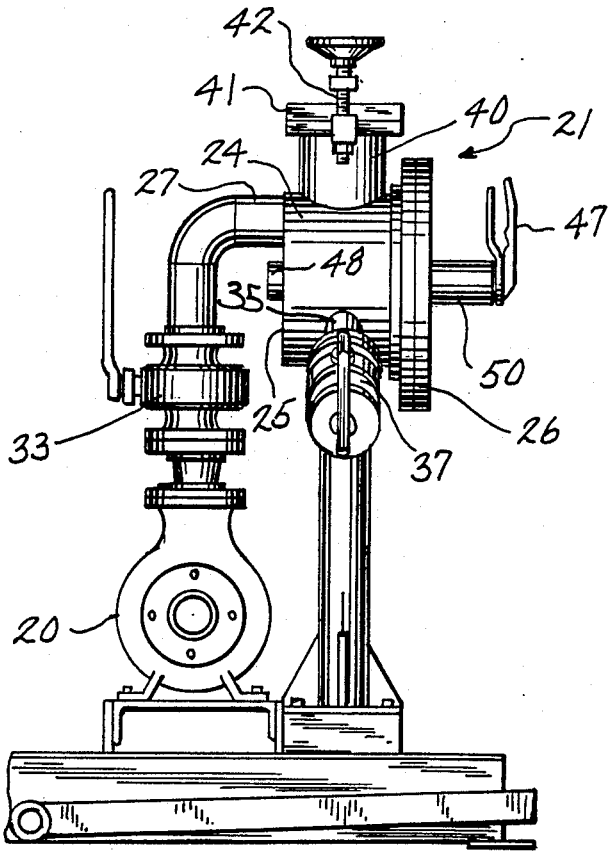
FIG. 4 is a side elevation of the apparatus shown in FIG. 3.

Referring also to FIGS. 2–4, the ball collector apparatus 21 of the present invention is operable to provide several important functions in the overall system shown in FIG. 1. First of all, the collector 21 includes a normal operating position in which the balls are allowed to flow directly therethrough for recirculation. The ball collector may also be operated to temporarily collect and hold the balls, as while the ball strainer screen 22 is being backwashed. Finally, the collector may be operated to remove damaged or worn balls completely from the system and to replace them with new balls.

The ball collector 21 includes a housing 23 comprising a cylindrical outer wall 24 and opposite end walls 25 and 26. End wall 25 includes a flow inlet 27 in fluid communication with the upstream section 28 of the parallel branch pipe 17, and a flow outlet 30 connected to the downstream section 31 of the pipe 17. The upstream pipe section 28 includes the ball circulating pump 20 which provides the flow necessary to divert the balls from the return pipe 14 at the ball strainer 18 and inject them into the main supply line 13 for circulation through the heat exchanger. An inlet flow control valve 33 is mounted in pipe section 28 just upstream of the flow inlet 27. Similarly, an outlet flow control valve 34 is mounted in pipe section 31 just downstream of the flow outlet 30. A ball outlet opening 35 is provided in the lower portion of the cylindrical outer wall 24 at a position generally below the flow inlet and flow outlet 30. The ball outlet 35 preferably comprises a flanged sleeve 36 to which is attached a ball discharge valve 37.

In a typical ball cleaning system, utilizing balls having a nominal diameter less than 1 ½", the pipe sections 28 and 31 and the flow inlet and outlet 27 and 30 may each have a nominal ID of about 3". The ball outlet 35 and flange 36 may be of a slightly smaller diameter, e.g. 2". The top of the cylindrical wall 24 of the housing 23 is provided with a substantially larger ball filling inlet 38. The ball filling inlet 38 includes a large flanged sleeve 40 to which a plate 41 may be attached with a manually operated clamping mechanism 42. The cover 41 is provided with a screen 59 which fits down inside the flanged sleeve 40 when the cover is in place and prevents the balls from entering the sleeve.

Inside the housing 23, a ball-retaining screen 43 is pivotally mounted for rotation therein on the axis of the cylindrical outer wall 24. The screen has an upper ball retaining surface 44 which may be of any convenient perforated or foraminous construction allowing the cooling water to pass therethrough, but retaining the balls 19 thereon. The screen 43 includes a generally rectangular outer frame 45 to which is secured a pivot shaft 46. One end of the pivot shaft 46 is journalled for rotation in a support bearing 48 in end wall 25 and the other end extends through the other end wall 26 and into a journal housing 50 for attachment to a control lever 47. Manual operation of control lever 47 effects rotation of the pivot shaft and, likewise, rotation of the screen 43 within the housing 23. A suitable automatic mechanical actuator (not shown) could be substituted for or used in addition to the control lever 47.

Referring particularly to FIG. 2, the ball-retaining screen 43 is shown in its normal operating or ball recirculating position 51. In this position, the screen surface 44 is disposed below the flow inlet 27 and flow outlet 30, and the ball outlet 35 is disposed on the opposite side of the screen. With inlet valve 33 and outlet valve 34 open and the pump 32 operating, the flow of water and balls 19 will pass directly through the collector housing 23 from the inlet 27 to the outlet 30. During this recirculating flow, ball discharge valve 37 is closed, however, the screen is positioned to prevent any balls from entering the ball outlet 35.

When it is desired to temporarily collect the balls 19, as for backwashing the ball strainer screen 22, the ball-retaining screen 43 is rotated to the collecting and holding position 52 where only the flow inlet opening 27 is disposed on the ball retaining side of the screen. Flow control valves 33 and 34 are maintained open and flow through the collector housing continues, but the balls 19 are retained on the upper surface 44 of the screen. As in the recirculating position 51, the ball discharge valve 37 is retained closed in the collecting and holding position 52. However, it is still desirable to have the ball outlet 35 positioned below the screen 43 to again prevent the unintended entry of balls into the outlet 35. Flow through the collector housing is maintained until substantially all of the balls have been removed from the system and are collected and held on the upper screen surface 44. After the ball strainer screen has been backwashed and returned to its straining position, the collector screen 43 may be rotated back to the recirculating position 51 and the balls allowed to reenter the system for circulation through the heat exchanger 12 for passage through the condenser tubes 16.

When the balls 19 have become sufficiently worn or damaged such that their cleaning effectiveness has been diminished, the screen 43 is rotated to the discharging position 53 with the upper screen surface 44 disposed at approximately the lower edge of ball outlet 35. All the balls are collected on the screen 43 as previously indicated. Outlet and inlet flow control valves 34 and 33, respectively, are closed and the ball discharge valve 37 is then opened and the balls and a portion of the water in the closed housing drain by gravity through the open valve 37 to a convenient ball collecting container 54.

To replace the balls previously collected and discharged from the system or to add additional balls to the system, all of the valves 33, 34 and 37 are initially closed. The cover plate 41 is removed from the flanged sleeve 40 around the ball filling inlet 38 and, with the ball screen 43 preferably in the collecting and holding position 52, a fresh supply of balls 19 is added to the housing. If the newly added balls have been previously de-aerated and saturated with water externally of the collector, utilizing for example one of the prior art methods previously described, the balls are ready for re-entry into the system and the screen need only be repositioned to the recirculating position and the valves 33 and 34 reopened.

The apparatus of the present invention also includes a simple but unique means for the in situ deaeration of newly added cleaning balls. A vacuum line 55 is attached to a high point in the collector housing 23, such as near the top of the large flanged sleeve 40 defining the ball inlet 38. The vacuum line 55 is provided with an appropriate stand pipe 56 to prevent the entry of water into the vacuum line. A vacuum pump 57 is operatively attached to the vacuum line 55.

With all of the valves 33, 34 and 37 closed, a supply of dry balls 19 is added to the interior of the housing through the ball filling inlet 38. Water is then added to the housing, as by opening inlet flow control valve 33, to substantially fill the interior thereof to a level above a removable screen 59, but not above the opening for the vacuum line 55 in sleeve 40. The cover plate 41 is reattached and sealed with the clamping mechanism 42. The vacuum pump is then operated to draw a vacuum in the space above the water level which will also draw the air out of the dry balls. The balls, which are held below the water level by the screen, will become saturated with water (and the water level will incidentally also drop in the housing). The de-aerated and saturated balls are ready for entry into the system, as previously described. The need for external de-aeration equipment is obviated, as is the inconvenience of handling saturated balls. The vacuum line 55 may be provided with a suitable valve 58 to prevent the entry of water when not in use and a level control 60 to shut the vacuum pump off in the event water is being drawn into the vacuum line.

Various modes of carrying out the present invention are contemplated as being within the scope of the following claims particularly pointing out and distinctly claiming the subject matter which is regarded as the invention:

We claim:

1. In a pipe cleaning system wherein porous resilient foam rubber balls are circulated in a flow of water through the pipes to be cleaned, an apparatus for selectively recirculating the balls, collecting and holding the balls, and discharging the balls from the system, said apparatus comprising:

a housing having a cylindrical outer wall and opposite end walls;

a ball-retaining screen pivotally mounted within the housing for rotation on the axis of said cylindrical outer wall;

a flow inlet, a flow outlet, and a ball outlet in the housing;

said screen being selectively rotatable between:

a ball recirculating position with the flow inlet and flow outlet disposed on a ball-retaining side of the screen;

a ball collecting and holding position with the flow inlet disposed on the ball-retaining side of the screen; and, a ball discharging position with the ball outlet disposed on the ball retaining side of the screen; and, means for controlling the flow through the housing and for controlling the discharge through said ball outlet.

2. The apparatus as set forth in claim 1 wherein rotation of said screen between said positions is serial and in the same circumferential direction.

3. The apparatus as set forth in claim 2 wherein said ball collecting and holding position comprises a circumferentially intermediate position.

4. The apparatus as set forth in claim 1 wherein said flow controlling means comprises a first flow control valve upstream of said flow inlet, a second flow control valve downstream of said flow outlet, and a drain valve downstream of said ball outlet.

5. The apparatus as set forth in claim 4 wherein the discharge through said ball outlet and drain valve is by gravity flow.

6. The apparatus as set forth in claim 5 wherein the flow outlet and the ball outlet are disposed on the side of the screen opposite the ball-retaining side in the ball collecting and holding position.

7. The apparatus as set forth in claim 6 wherein the flow inlet is disposed on the ball-retaining side in the ball discharging position.

8. The apparatus as set forth in claim 5 wherein said flow inlet and said flow outlet are disposed in one of the end walls.

9. The apparatus as set forth in claim 8 wherein said flow inlet and flow outlet are disposed in the same end wall.

10. The apparatus as set forth in claim 9 wherein said ball outlet is disposed in said cylindrical outer wall.

11. The apparatus as set forth in claim 10 including position control means operatively attached to said screen and extending through the end wall opposite said flow inlet and flow outlet.

12. The apparatus as set forth in claim 11 including a pivot shaft attached to said screen and having opposite ends supported for rotation in said end walls.

13. The apparatus as set forth in claim 12 wherein said position control means is attached to one end of said pivot shaft.

14. The apparatus as set forth in claim 13 wherein said position control means comprises a manually operable lever.

15. The apparatus as set forth in claim 10 wherein the axis of said cylindrical outer wall is horizontally disposed.

16. The apparatus as set forth in claim 15 wherein said ball outlet is disposed in the lower half of said outer wall below said flow inlet and flow outlet.

17. The apparatus as set forth in claim 4 comprising a ball filling inlet in the upper portion of said housing above said flow inlet, flow outlet and ball outlet.

18. The apparatus as set forth in claim 17 including a removable cover for said ball inlet.

19. The apparatus as set forth in claim 18 wherein said flow control means is further operative to fill the housing with water to an initial level below said cover.

20. The apparatus as set forth in claim 19 including ball de-aeration means for creating a vacuum in the housing above said initial water level.

21. The apparatus as set forth in claim 20 wherein said cover includes screen means extending into said ball inlet for holding balls below the water surface during operation of said de-aeration means.

* * * * *